US012559877B2

(12) United States Patent
Angelini et al.

(10) Patent No.: US 12,559,877 B2
(45) Date of Patent: Feb. 24, 2026

(54) STRUCTURED GEOMETRY FOR A TUB REAR WALL OF A LAUNDRY APPLIANCE

(71) Applicant: WHIRLPOOL CORPORATION, Benton Harbor, MI (US)

(72) Inventors: Marco Angelini, Folignano (IT); Matteo Carnevale, Esanatoglia (IT); Crescenzo Iannicelli, Sacile (IT); Andrea Ienko, Ancona (IT); Stefano Turchi, Falconara Marittima (IT)

(73) Assignee: Whirlpool Corporation, Benton Harbor, MI (US)

( * ) Notice: Subject to any disclaimer, the term of this patent is extended or adjusted under 35 U.S.C. 154(b) by 872 days.

(21) Appl. No.: 17/863,866

(22) Filed: Jul. 13, 2022

(65) Prior Publication Data

US 2023/0064111 A1 Mar. 2, 2023

Related U.S. Application Data

(60) Provisional application No. 63/238,525, filed on Aug. 30, 2021.

(51) Int. Cl.

| | |
|---|---|
| ***D06F 37/26*** | (2006.01) |
| ***D06F 23/02*** | (2006.01) |
| ***D06F 37/22*** | (2006.01) |
| ***D06F 58/02*** | (2006.01) |

(52) U.S. Cl.

CPC ..... *D06F 37/264* (2013.01); *D06F 23/02* (2013.01); *D06F 37/22* (2013.01); *D06F 58/02* (2013.01)

(58) Field of Classification Search

CPC ..... D06F 37/264; D06F 23/02; D06F 37/22; D06F 58/02

USPC ..... 34/201, 595–610

See application file for complete search history.

(56) References Cited

U.S. PATENT DOCUMENTS

| | | | | |
|---|---|---|---|---|
| 5,211,038 | A | 5/1993 | Valent | |
| 5,329,791 | A | 7/1994 | Cargnel et al. | |
| 7,353,622 | B2 * | 4/2008 | Bringewatt | D06F 37/30 34/312 |
| 7,578,151 | B2 | 8/2009 | Blomberg et al. | |
| 8,336,341 | B2 * | 12/2012 | Kim | D06F 37/262 68/210 |
| 8,402,797 | B2 | 3/2013 | Kim et al. | |
| 8,453,428 | B1 * | 6/2013 | Kinde, Sr. | F02K 7/16 60/39.15 |
| 8,485,002 | B2 * | 7/2013 | Quandt | D06F 37/262 68/142 |
| 8,677,789 | B2 | 3/2014 | Gracia Bobed et al. | |
| 9,175,432 | B2 * | 11/2015 | Del Pos | D06F 39/125 |

(Continued)

FOREIGN PATENT DOCUMENTS

| | | | |
|---|---|---|---|
| DE | 102007044882 | 4/2009 | |
| EP | 2574694 A1 * | 4/2013 | D06F 37/269 |

(Continued)

*Primary Examiner* — Stephen M Gravini

(74) *Attorney, Agent, or Firm* — Price Heneveld LLP

(57) ABSTRACT

A tub for a laundry appliance, includes a rear wall having a bearing hub for receiving a drive shaft. A plurality of inner radial walls extend from the bearing hub to a convergence wall. A circumferential wall extends concentrically about the bearing hub to engage one of the inner radial walls and the convergence wall. A plurality of outer diverging walls extends from the convergence wall to an outer edge of the rear wall.

20 Claims, 6 Drawing Sheets

(56) References Cited

U.S. PATENT DOCUMENTS

| | | | | |
|---|---|---|---|---|
| 9,493,903 | B2 * | 11/2016 | Yu | F04D 29/666 |
| 9,850,614 | B2 * | 12/2017 | Chiriatti | D06F 58/06 |
| 10,053,809 | B2 * | 8/2018 | Kim | D06F 37/269 |
| 10,988,885 | B2 * | 4/2021 | Farrington | D06F 37/30 |
| 12,129,587 | B2 * | 10/2024 | Carnevale | D06F 29/005 |
| 12,244,249 | B1 * | 3/2025 | Lin | H02P 23/0004 |
| 2006/0236729 | A1 | 10/2006 | Hollenhorst et al. | |
| 2009/0107187 | A1 | 4/2009 | Kim et al. | |
| 2010/0186462 | A1 | 7/2010 | Quandt et al. | |
| 2011/0289984 | A1 | 12/2011 | Kim et al. | |
| 2013/0074553 | A1 * | 3/2013 | Cha | D06F 37/206 68/140 |
| 2014/0102151 | A1 * | 4/2014 | Yoon | H02K 15/03 310/114 |
| 2016/0194801 | A1 | 7/2016 | Kim et al. | |
| 2020/0208323 | A1 | 7/2020 | Farrington et al. | |

FOREIGN PATENT DOCUMENTS

| | | | | |
|---|---|---|---|---|
| EP | 2722971 | A2 * | 4/2014 | D06F 37/20 |
| KR | 10-2006-0085798 | | 7/2006 | |
| KR | 20130034132 | A * | 4/2013 | D06F 37/304 |
| WO | 2011072712 | | 6/2011 | |
| WO | 2012065854 | | 5/2012 | |
| WO | 2020130966 | | 6/2020 | |

* cited by examiner

STRUCTURED GEOMETRY FOR A TUB REAR WALL OF A LAUNDRY APPLIANCE

CROSS-REFERENCE TO RELATED APPLICATION

This application claims priority to and the benefit under 35 U.S.C. § 119(e) of U.S. Provisional Patent Application No. 63/238,525, filed on Aug. 30, 2021, entitled STRUCTURED GEOMETRY FOR A TUB REAR WALL OF A LAUNDRY APPLIANCE, the entire disclosure of which is hereby incorporated herein by reference.

BACKGROUND OF THE DISCLOSURE

The present disclosure generally relates to laundry appliances, and more specifically, a tub for a laundry appliance that includes a rear wall having a structured geometry where no single reinforcing wall extends linearly and continuously between a central hub and an outer edge of the rear wall.

SUMMARY OF THE DISCLOSURE

According to one aspect of the present disclosure, a tub for a laundry appliance, includes a rear wall having a bearing hub for receiving a drive shaft. A plurality of inner radial walls extend from the bearing hub to a convergence wall. A circumferential wall extends concentrically about the bearing hub to engage one of the inner radial walls and the convergence wall. A plurality of outer diverging walls extends from the convergence wall to an outer edge of the rear wall.

According to another aspect of the present disclosure, a tub for a laundry appliance includes a rear wall having a bearing hub for receiving a drive shaft. A plurality of inner radial walls extend from the bearing hub to a circumferential wall. A plurality of outer diverging walls that extend from the circumferential wall to an outer edge of the rear wall. Each of the inner radial walls are positioned out of alignment with each of the outer diverging walls.

According to yet another aspect of the present disclosure, a tub for a laundry appliance includes a rear wall having a bearing hub for receiving a drive shaft. A plurality of inner radial walls extend from the bearing hub to respective T-shaped reinforcements. Each of the respective T-shaped reinforcements includes a concentrically extending wall with opposing ends. Outer diverging walls extend from each opposing end of each T-shaped reinforcement.

These and other features, advantages, and objects of the present disclosure will be further understood and appreciated by those skilled in the art by reference to the following specification, claims, and appended drawings.

Figure 1:
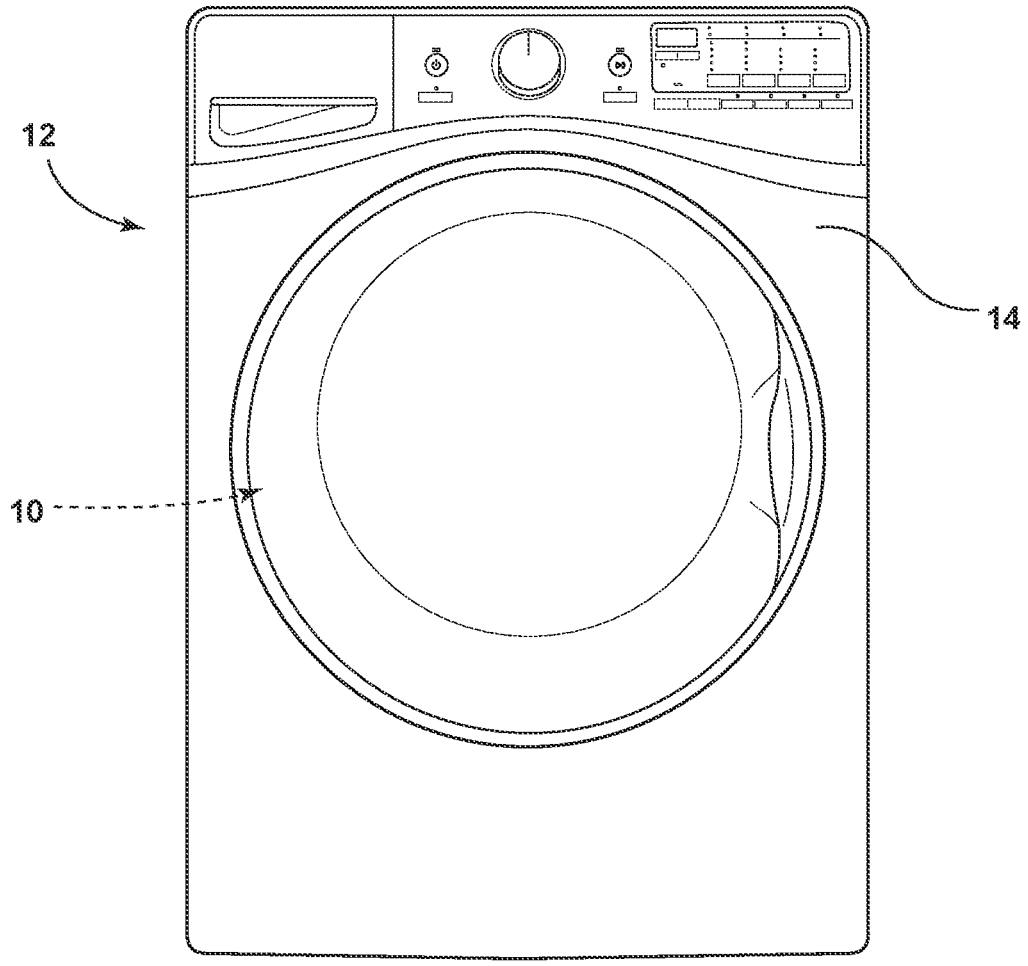
FIG. 1 is a front elevational view of a laundry appliance incorporating an aspect of the reinforcing walls within a rear wall of the tub.

The components in the figures are not necessarily to scale, emphasis instead being placed upon illustrating the principles described herein.

DETAILED DESCRIPTION

The present illustrated embodiments reside primarily in combinations of method steps and apparatus components related to a tub for a laundry appliance having a rear wall with reinforcing walls configured in a structural geometry such that no single reinforcing wall extends linearly from a central bearing hub to an outer edge of the rear wall. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-6, reference numeral 10 generally refers to a tub for a laundry appliance 12 that is positioned within an outer cabinet 14. The tub 10 includes a rear wall 16 that supports a portion of a motor assembly 18. The rear wall 16 includes central aperture 20 having a bearing hub 22 that is attached to the rear wall 16 via fasteners, injection molding, or other similar mechanism or method. According to the various aspects of the device, the tub 10 includes the rear wall 16 having the bearing hub 22 that receives a drive shaft 24 of the motor assembly 18. The rear wall 16 includes a plurality of reinforcing walls 26 having a structural geometry configured according to the various aspects, as described herein. The reinforcing walls 26 include a plurality of inner radial walls 28 that extend from the bearing hub 22 to a convergence wall 30. A circumferential wall 32 extends concentrically about the bearing hub 22 to engage at least one of the inner radial walls 28 and the convergence wall 30. A plurality of outer diverging walls 34 extend from the convergence wall 30 to an outer edge 36 of the rear wall 16. Through this configuration, each of the inner radial walls 28 and each of the outer diverging walls 34 extend only a portion of the radial distance 38 between the bearing hub 22 and the outer edge 36 of the rear wall 16. In addition, this configuration limits the number of reinforcing walls 26 that intersect at a given intersection point 62. In this manner, where a plurality of reinforcing walls 26 engage one another within a relatively small intersection space 40, such as at the convergence wall 30, the convergence wall 30 spreads the various forces experienced by the reinforcing walls 26 over a larger area to limit the directional forces experienced at each intersection point 62.

Figure 3:
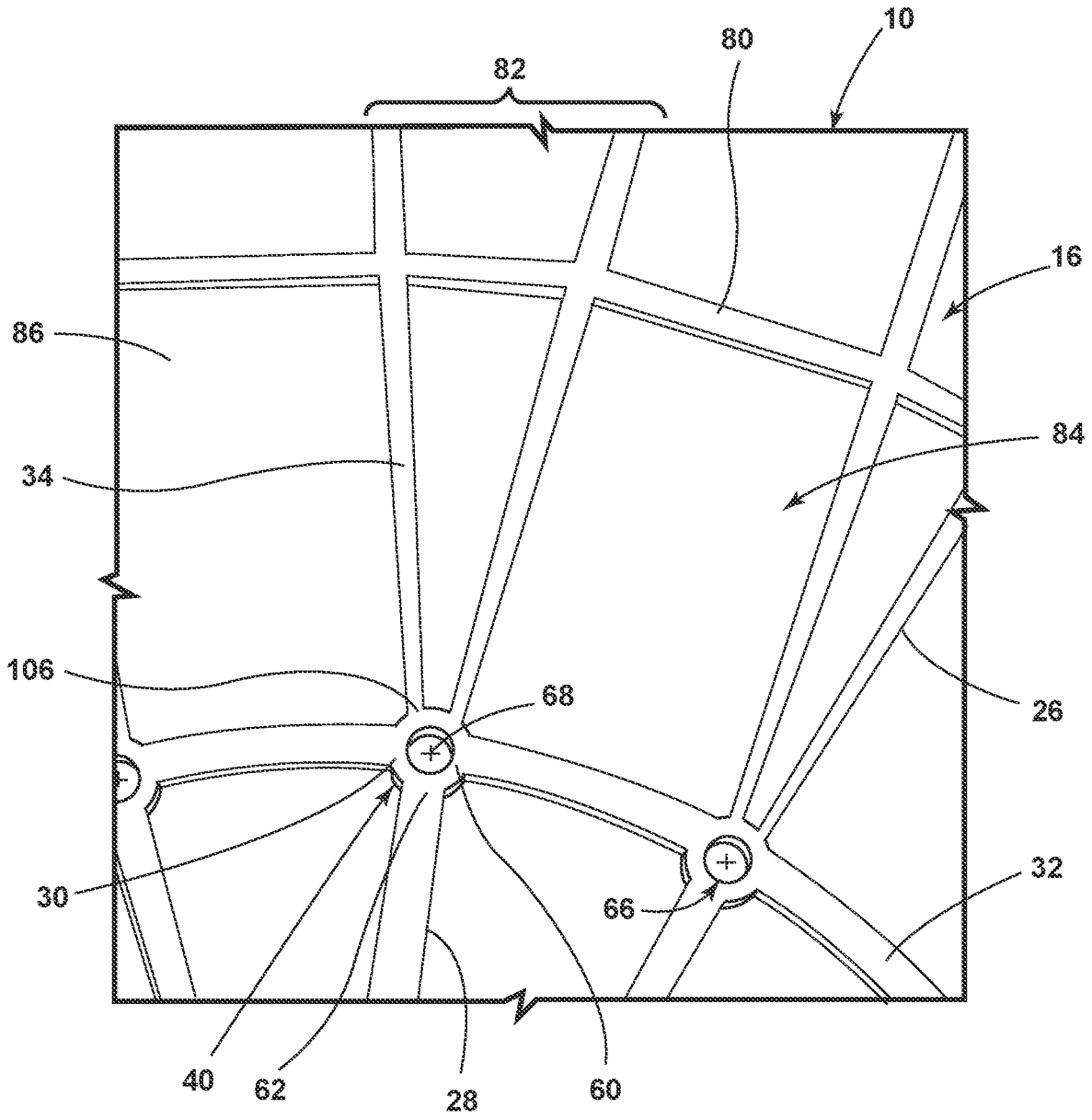
FIG. 3 is a partial rear perspective view of an aspect of the structural geometry of the reinforcing walls of the rear wall for the tub.
Figure 4:
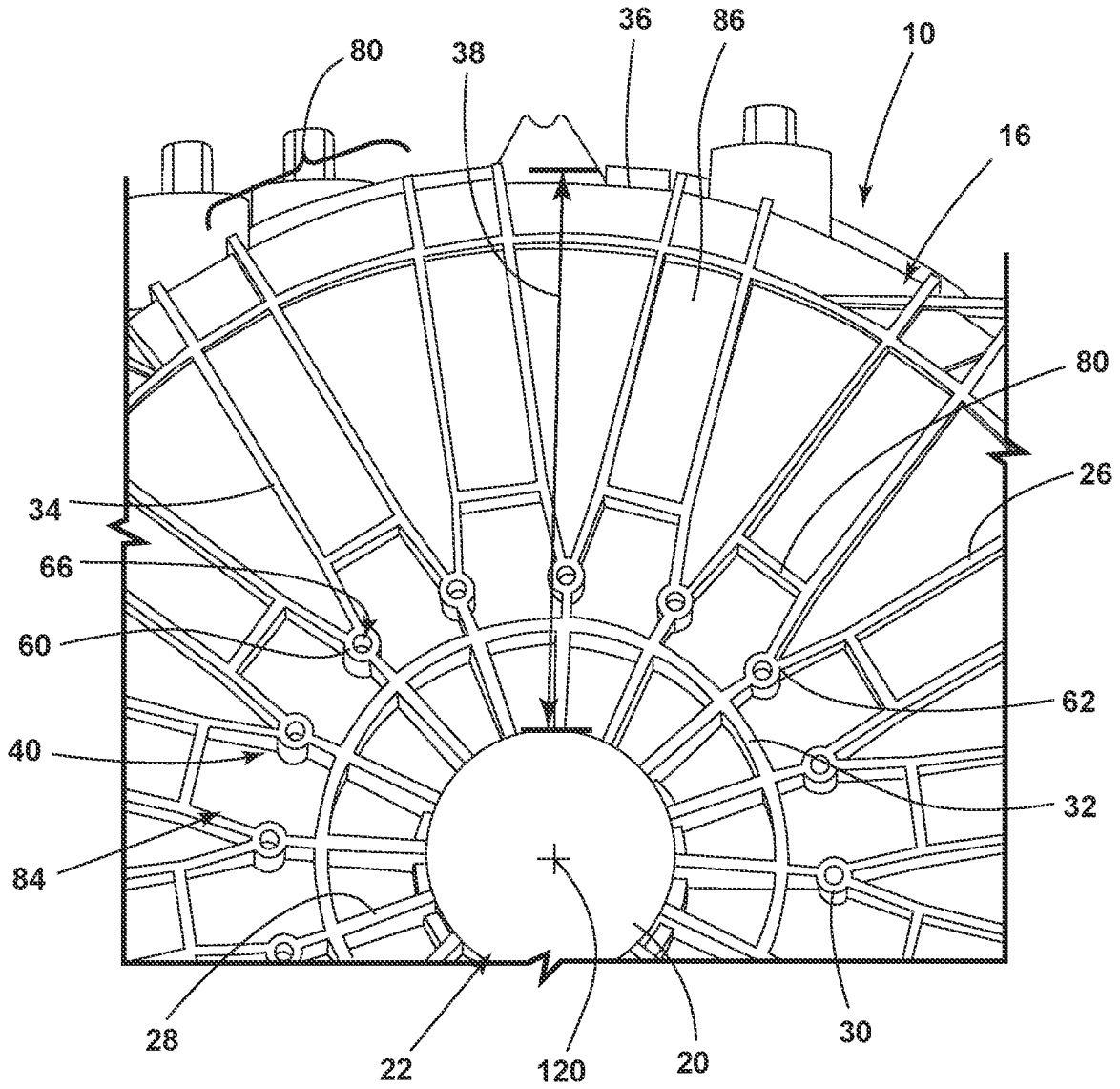
FIG. 4 is a partial rear perspective view of an aspect of the structural geometry of the reinforcing walls of the rear wall for the tub.

Referring now to FIGS. 3 and 4, the convergence wall 30 is typically in the form of the cylindrical wall 60 that extends concentrically about an interior void 66. Within the interior void 66 is a reference point 68, typically an imaginary reference point 68, that corresponds to a point where an inner radial wall 28 and the corresponding outer diverging walls 34 would intersect, if the convergence wall 30 was not present. Because this intersection point 62 is within the interior void 66 within the convergence wall 30 and is maintained free of plastic material of the rear wall 16, the various forces experienced by the reinforcing walls 26 can be spread more efficiently through the intersection space 40 defined by the joinder of the inner radial walls 28, the outer radial walls and the structure of the cylindrical convergence wall 30. This is particularly true where the convergence wall 30 defines an intersection between one of the inner radial walls 28, a pair 82 of outer diverging walls 34 as well as the circumferential wall 32 that extends concentrically about the bearing hub 22. The intersection of these reinforcing walls 26 can be spread throughout the larger intersection space 40 through the use of the convergence wall 30 that provides a greater structural integrity at this area of intersection. Stated another way, the convergence wall 30 provides a cylindrical (or other shaped) intersection space 40 that receives various reinforcing walls 26 that extend radially and concentrically throughout the rear wall 16 of the tub 10. Additionally, within the intersection space 40, no more than two reinforcing walls 26 intersect at any one intersection point 62.

Within conventional washtubs, various reinforcing features within a back wall of the washtub engage one another at a very specific point, where numerous reinforcing features engage one another at a precise point. These points of intersection of the reinforcing features have been found to be a point of weakness due to the large amount of forces being transferred through the reinforcing features and toward this single point of intersection within the back wall of the washtub. Due to these high forces and multi-directional forces that are experienced within a very small area that is defined by the point of intersection of the reinforcing features of the washtub, this has been found to be a point of repeated failure in conventional washtubs.

Referring again to FIGS. 1-6, the expanded intersection space 40 represents multiple intersection points 62 between the various reinforcing walls 26 of the rear wall 16 of the tub 10. Using this intersection space 40, forces that extend along and through the reinforcing walls 26 can be transferred at an intersection of only two reinforcing walls 26 that engage one another at any one intersection point 62. In addition, these intersections of the various reinforcing walls 26 can be made to be substantially perpendicular with one another so that highly acute or highly obtuse angles of intersection can be avoided within the reinforcing walls 26 of the rear wall 16 of the tub 10. In particular, the use of a cylindrical convergence wall 30 as well as the circumferential wall 32, as will be described more fully below, provides a number of distinct and separate intersection points 62 between only two reinforcing walls 26 for the rear wall 16.

Referring again to FIGS. 3 and 4, the convergence wall 30 can be positioned to receive one of the inner radial walls 28, a pair 82 of outer convergence walls 30, as well as the circumferential wall 32. In addition, it is contemplated that the cylindrical convergence wall 30 can be utilized as the intersection space 40 defined between the inner radial wall 28 and a pair 82 of outer diverging walls 34. In such an embodiment, the circumferential wall 32 can be juxtaposed or offset to intersect the inner radial walls 28 away from the cylindrical convergence wall 30. Using this configuration, the convergence wall 30 can receive one inner radial wall 28 and two outer diverging walls 34 without diminishing the structural integrity of the reinforcing walls 26 of the rear wall 16 of the tub 10. Additionally, in certain aspects of the device, the convergence wall 30 can also receive the circumferential wall 32 without diminishing the structural integrity of the reinforcing walls 26.

Figure 2:
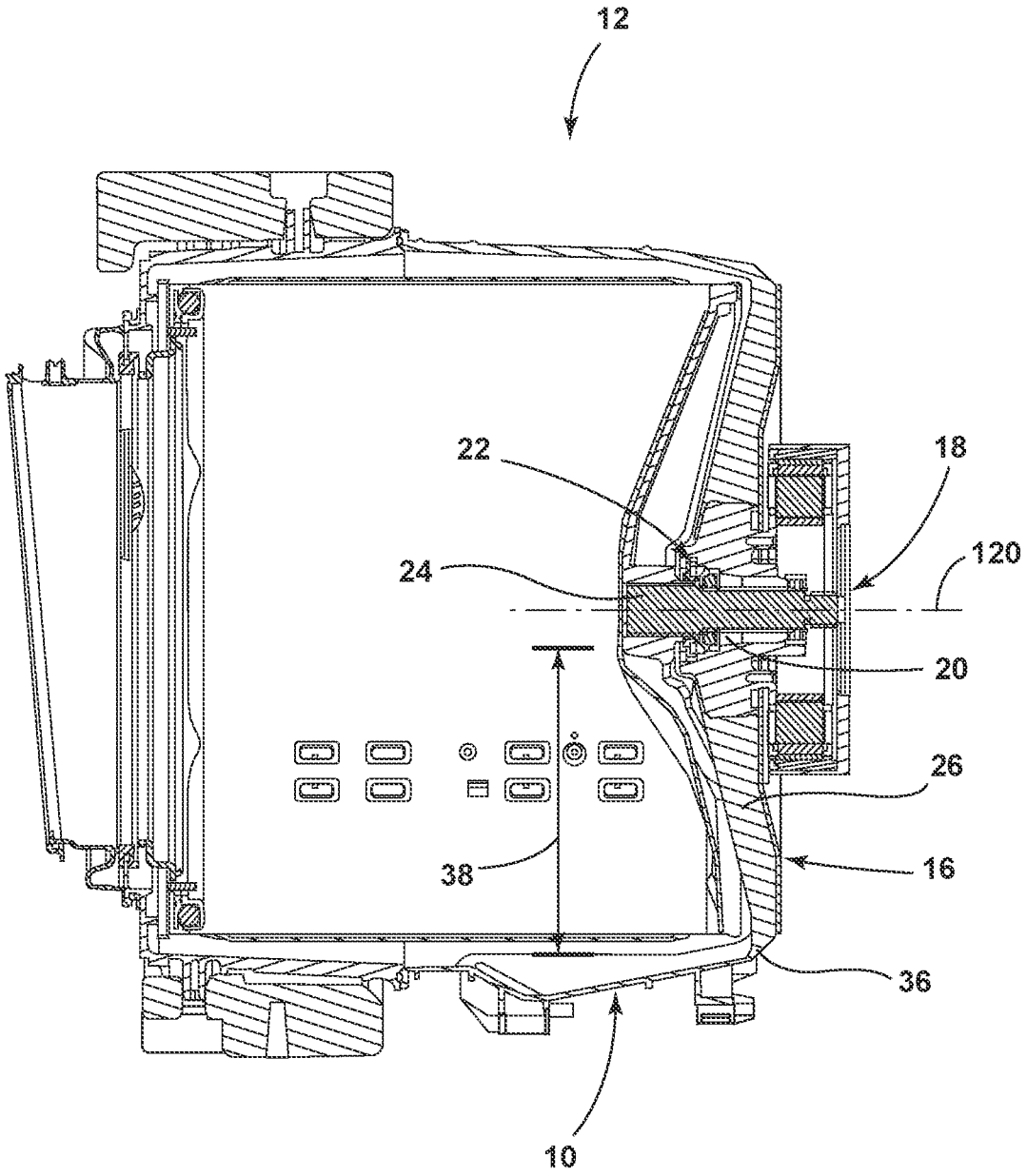
FIG. 2 is a cross-sectional view of a laundry appliance having a tub with a rear wall that includes reinforcing walls according to at least one aspect of the device, as disclosed herein.
Figure 5:
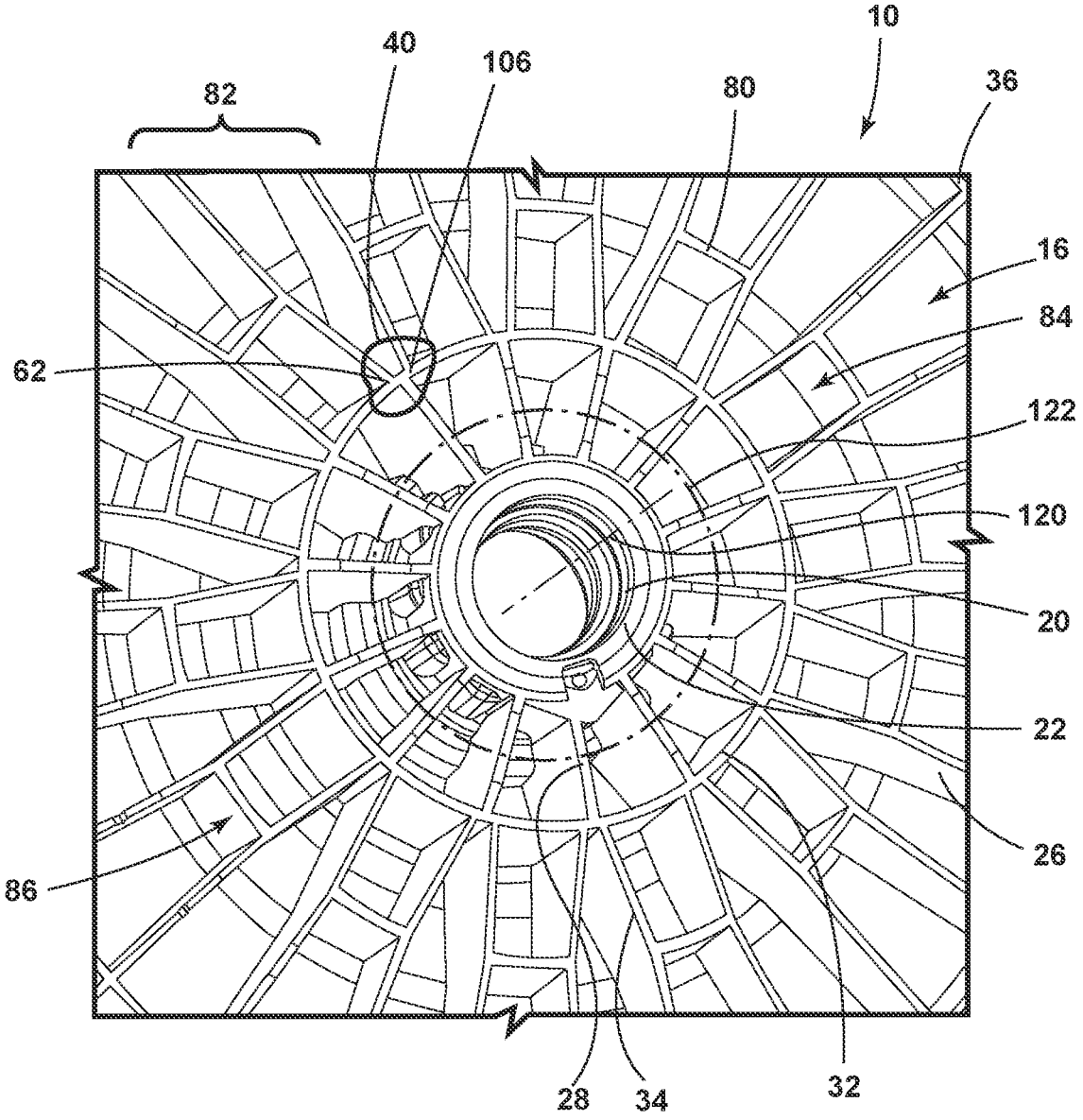
FIG. 5 is a partial rear perspective view of an aspect of the structural geometry of the reinforcing walls of the rear wall for the tub.

Referring now to FIG. 5, the tub 10 for the laundry appliance 12 includes the rear wall 16 having the bearing hub 22 that receives the drive shaft 24 (shown in FIG. 2). The plurality of inner radial walls 28 extend into the bearing hub 22 and to the circumferential wall 32. The plurality of outer diverging walls 34 extend from the circumferential wall 32 to the outer edge 36 of the rear wall 16. In this configuration, each of the inner radial walls 28 are positioned out of alignment with each of the outer diverging walls 34. Through this configuration, each of the inner radial walls 28 and the outer diverging walls 34 engages the circumferential wall 32 at a unique location of the circumferential wall 32. This spreads these intersection points 62 apart to define a larger intersection space 40.

As discussed herein, this configuration of the reinforcing walls provides for a plurality of intersection points 62 that include only the circumferential wall 32 and one other reinforcing wall 26. This allows the various forces that are transferred through the reinforcing walls 26 to be transferred between only a pair 82 of reinforcing walls 26 that are positioned generally perpendicular with respect to one another. This provides for greater structural integrity at each intersection point 62 of each of the intersecting reinforcing walls 26, as well as a system of reinforcing walls 26 that is located at the rear wall 16 of the tub 10. This also provides for a system of reinforcing walls 26 that include shorter linear walls that do not extend linearly from the bearing hub 22 to the outer edge 36. These shorter reinforcing walls 26 are better able to absorb these forces exerted in the rear wall 16 without resulting in a greater amount of deflection that may cause damage to the reinforcing walls 26.

Referring again to FIG. 5, each of the inner radial walls 28 engages the circumferential wall 32 at a regular radial interval about the bearing hub 22. Flanking each of the inner radial walls 28 is a plurality of (typically two) outer diverging walls 34 that extend from the circumferential wall 32 to the outer edge 36 of the tub 10. As discussed herein, the flanking configuration of the outer diverging walls 34 engages the circumferential wall 32 at different intersection points 62 than that of the corresponding inner radial wall 28. Again, this provides for a larger intersection space 40 to account for the various forces that are experienced by the rear wall 16 of the tub 10 and the reinforcing walls 26 thereof.

Referring again to FIG. 5, within the outer diverging walls 34, various blocking walls 80 can extend between adjacent reinforcing walls 26 of the outer diverging walls 34. In certain aspects of the device, the blocking walls 80 can be positioned to extend between adjacent pairs 82 of the outer diverging walls 34. Stated another way, as the pairs 82 of outer diverging walls 34 extend outward relative to a corresponding inner radial wall 28, the blocking walls 80 extend from one reinforcing wall 26 of the pair 82 of outer diverging walls 34 toward an adjacent reinforcing wall 26 that is part of a separate pair 82 of outer diverging walls 34. This geometry provides for a series of closed geometries 84 that are formed by the reinforcing walls 26 and the rear wall 16 of the tub 10. These closed geometries 84 can be in the form of a series of rectilinear, trapezoidal, or other polygonal geometries that extend from the bearing hub 22 in a generally outward direction. Through this configuration, while the reinforcing walls 26 are not aligned between the bearing hub 22 and the outer edge 36 of the rear wall 16, the spaces defined within the closed geometries 84 can form a series of outwardly radiating cavities 86, having different shapes and sizes that extend from the bearing hub 22 to the outer edge 36. These radiating cavities 86 can be separated by the circumferential wall 32 and the blocking walls 80. The blocking walls 80 can also be in the form of a circumferential reinforcement that extends circumferentially about the bearing hub 22. Depending upon the size of the rear wall 16 of the tub 10, additional circumferential walls 32 and additional blocking walls 80 can be disposed within and among the reinforcing walls 26 of the rear wall 16 of the tub 10.

Referring again to FIG. 5, the various radiating cavities 86 that are formed between the reinforcing walls 26 of the rear wall 16 of the tub 10 include interlocking and/or repeating geometries that are formed by the closed geometries 84 of the reinforcing walls 26. These closed geometries 84 formed by the reinforcing walls 26 serve to efficiently transfer forces throughout the reinforcing walls 26 of the rear wall 16 of the tub 10. These reinforcing closed geometries 84 can be generally trapezoidal in shape, rectilinear in shape, generally hourglass shaped, generally triangular, and can include other various polygons and arcuate shapes that can be repeated circumferentially about the bearing hub 22 of the rear wall 16, as described herein.

Figure 6:
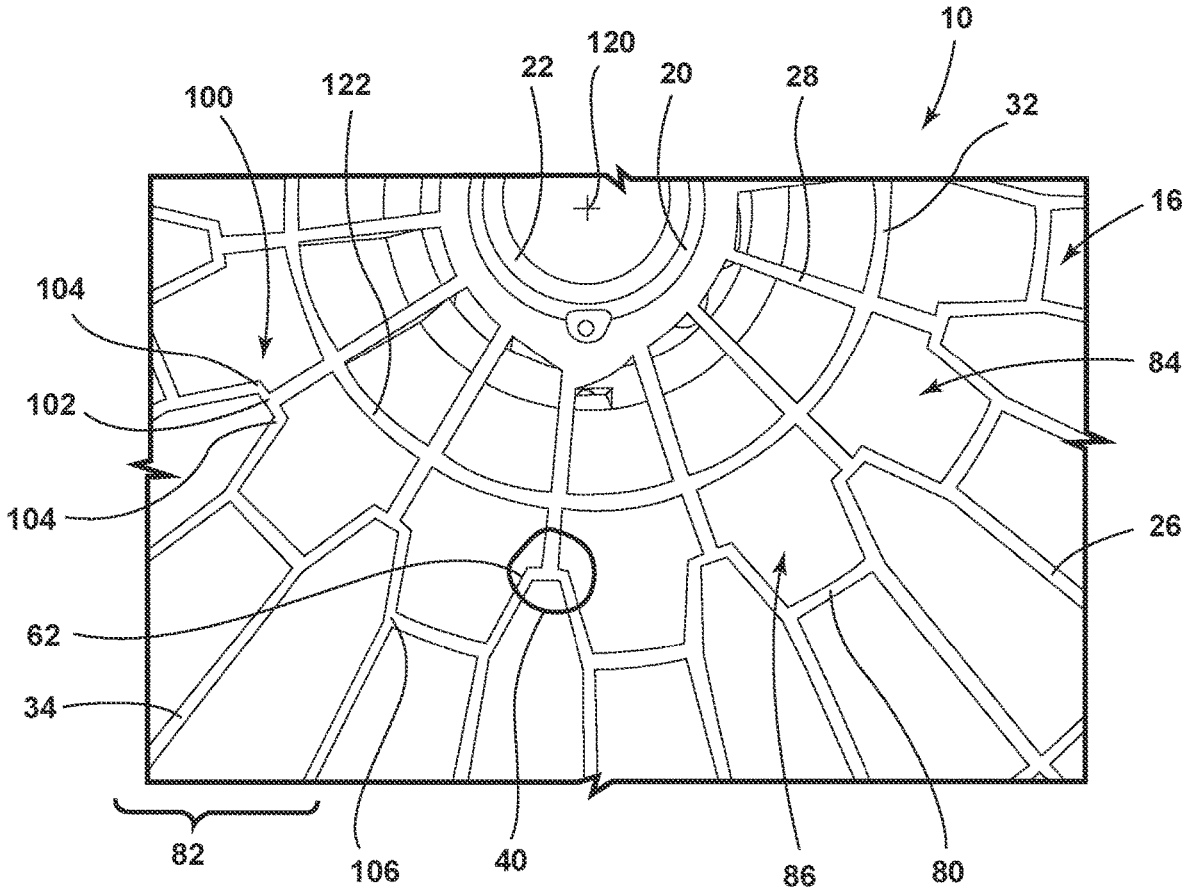
FIG. 6 is a partial rear perspective view of an aspect of the structural geometry of the reinforcing walls of the rear wall for the tub.

Referring now to FIG. 6, the tub 10 for the laundry appliance 12 of the rear wall 16 can include a bearing hub 22 for receiving the drive shaft 24. The plurality of inner radial walls 28 extend from the bearing hub 22 to respective T-shaped reinforcements 100. Each T-shaped reinforcement 100 includes a concentrically extending wall 102 with opposing ends 104. The concentrically extending walls 102 of the T-shaped reinforcements 100 are segmented portions of the circumferential wall 32 that extend only a small portion of the concentric distance about the bearing hub 22. Accordingly, the concentrically extending walls 102 of the T-shaped reinforcements 100 are wall segments that define opposing ends 104 of the T-shaped reinforcements 100. The outer diverging walls 34 extend from each opposing end 104 of the concentrically extending wall 102 for each T-shaped reinforcement 100.

As discussed herein, the various outer diverging walls 34 extend from the T-shaped reinforcement 100 to the outer edge 36 of the rear wall 16. The configuration of the various reinforcing walls 26, including the inner radial walls 28, the outer diverging walls 34 and the T-shaped reinforcements 100 are configured to minimize the number of reinforcing walls 26 that engage one another at each intersection point 62. These intersection points 62 are limited to only two reinforcing walls 26 that engage each other at each intersection point 62. A number of reinforcing walls 26 may engage each other at a particular intersection space 40 that define a number of reinforcing points 106. However, this intersection space 40 is spread out over a section of the rear wall 16 of the tub 10 so that various forces experienced by the rear wall 16 can be spread throughout several independent and separate reinforcing points 106 that are spaced apart from one another.

As exemplified in FIGS. 3-6, the blocking walls 80 can be positioned to within the outer diverging walls 34 and can extend between adjacent reinforcing walls 26 of the outer diverging walls 34. This geometry provides for a series of closed geometries 84 that are formed by the reinforcing walls 26 of the rear wall 16 of the tub 10. These closed geometries 84 can be defined by a concentric and alternating configuration between the blocking walls 80 and the cylindrical walls 60, the T-shaped reinforcement 100 or the reinforcing points 106. Accordingly, the respective reinforcements (60, 100 or 106) and the plurality of blocking walls 80 are positioned in an alternating configuration that extends concentrically about the bearing hub 22 to form the closed geometries 84. These closed geometries 84 add structural rigidity to the rear wall 16 of the tub 10.

Referring again to FIGS. 1-6, the central bearing hub 22 receives a drive shaft 24 from a motor assembly 18. This motor assembly 18 can be in the form of a direct-drive motor that is attached directly to the rear wall 16 of the tub 10. The motor assembly 18 can also be a belt-drive motor such that the motor is positioned toward the outer edge 36 of the rear wall 16 and a rotor is attached, via a belt, with the motor. In either of these configurations, the drive shaft 24 extends through the bearing hub 22. During operation of the laundry appliance 12, a suspension system for the tub 10 absorbs various forces that are exerted through the processing of laundry. These forces are transferred from the bearing hub 22 and outward through the rear wall 16 of the tub 10. Additionally, these forces can be transferred, via the suspension system, from the outer edge 36 of the rear wall 16 of the tub 10 toward the bearing hub 22. Using the various configurations of reinforcing wall 26 as described herein, the reinforcing walls 26 are positioned such that only two reinforcing walls 26 meet at a given reinforcing point 106. Various reinforcing points 106 can be agglomerated within a particular intersection space 40. However, these reinforcing points 106 provide for generally perpendicular intersection points 62 of only two reinforcing walls 26. Through this configuration, the various forces experienced by the rear wall 16 of the tub 10 during operation of the laundry appliance 12 can be efficiently transferred between the bearing hub 22 and the outer edge 36 of the rear wall 16.

In certain aspects of the device, the various walls of the reinforcing walls 26 can include various thicknesses. In at least one aspect, the inner radial walls 28 and the convergence wall 30 can include a common wall thickness. It is also contemplated that the convergence wall 30 and the outer diverging walls 34 can include a common wall thickness.

Referring again to FIGS. 1-6, the alignment of the inner radial walls 28 and the alignment of the outer diverging walls 34 can be different. In certain aspects of the device, the inner radial walls 28 can be oriented radially from and be aligned with a central rotational axis 120 of the bearing hub 22. The outer diverging walls 34 can radiate from a point along the corresponding inner radial wall 28, typically from some point along an imaginary or physical concentric ring 122 that is positioned between the bearing hub 22 and the convergence wall 30, the circumferential wall 32 or the T-shaped reinforcement 100. This configuration allows the inner radial wall 28 and the outer diverging walls 34 to meet at unique points along the convergence wall 30, the circumferential wall 32 or the T-shaped reinforcement 100, depending on the aspect of the device that is utilized. As discussed herein, this configuration prevents more than two of the reinforcing walls 26 from intersecting at any single point.

According to various aspects of the device, the rear wall 16 of the tub 10 can be entirely made of various plastics, polymers, or other similar moldable materials. The bearing hub 22 can be made of a metallic material that can be attached or insert injection molded within the material of the rear wall 16 of the tub 10. It is contemplated that various reinforcements 100 can be placed within the rear wall 16 of the tub 10 as insert injection molded pieces or attached reinforcements 100 that supplement the reinforcing walls 26 of the rear wall 16 of the tub 10. It is also contemplated that the reinforcing walls 26, as described herein, are typically sufficient for accounting for various forces that are exerted through the reinforcing walls 26 of the rear wall 16 of the tub 10.

The reinforcing walls 26 and the geometries described herein can be utilized within any one of various appliances 12. These appliances 12 can include, but are not limited to, washers, dryers, combination washers and dryers, and other similar appliances 12 that include a rotationally operable mechanism that extends through a rear wall 16 of a tub 10.

According to another aspect of the present disclosure, a tub for a laundry appliance, includes a rear wall having a bearing hub for receiving a drive shaft. A plurality of inner radial walls extend from the bearing hub to a convergence wall. A circumferential wall extends concentrically about the bearing hub to engage one of the inner radial walls and the convergence wall. A plurality of outer diverging walls extends from the convergence wall to an outer edge of the rear wall.

According to another aspect, the circumferential wall engages the convergence wall.

According to yet another aspect, the convergence wall is a cylindrical wall that extends concentrically about an imaginary reference point of each inner radial wall and the corresponding outer diverging walls.

According to another aspect of the present disclosure, each of the inner radial walls and each of the outer diverging walls extends only a portion of a radial distance from the bearing hub to the outer edge of the rear wall.

According to another aspect, the convergence wall includes a cylindrical wall with an interior void.

According to yet another aspect, the convergence wall interrupts the cylindrical wall to define the interior void.

According to another aspect of the present disclosure, the inner radial walls and the convergence wall have a common wall thickness.

According to another aspect, the convergence wall engages one inner radial wall and two outer diverging walls.

According to yet another aspect, a tub for a laundry appliance includes a rear wall having a bearing hub for receiving a drive shaft. A plurality of inner radial walls extend from the bearing hub to a circumferential wall. A plurality of outer diverging walls that extend from the circumferential wall to an outer edge of the rear wall. Each of the inner radial walls are positioned out of alignment with each of the outer diverging walls.

According to another aspect of the present disclosure, each of the inner radial walls and each of the outer diverging walls engages the circumferential wall at a unique location.

According to another aspect, each of the inner radial walls and each of the outer diverging walls extends only a portion of a radial distance from the bearing hub to the outer edge of the rear wall.

According to another aspect, the inner radial walls are aligned with a central rotational axis of the bearing hub, and the outer diverging walls are aligned with a point along an imaginary concentric ring that is positioned between the bearing hub and the circumferential wall.

According to yet another aspect, the circumferential wall is segmented into a plurality of concentrically extending walls that cooperate with the inner radial walls, respectively, to define a plurality of T-shaped reinforcements.

According to another aspect of the present disclosure, each of the T-shaped reinforcements includes a pair of opposing ends that are each attached to a corresponding outer diverging wall of the plurality of outer diverging walls.

According to another aspect, a plurality of blocking walls are positioned between respective pairs of outer diverging walls of the plurality of outer diverging walls.

According to yet another aspect, a tub for a laundry appliance includes a rear wall having a bearing hub for receiving a drive shaft. A plurality of inner radial walls extend from the bearing hub to respective T-shaped reinforcements. Each of the respective T-shaped reinforcements includes a concentrically extending wall with opposing ends. Outer diverging walls extend from each opposing end of each T-shaped reinforcement.

According to another aspect of the present disclosure, each of the inner radial walls and each of the outer diverging walls extends only a portion of a radial distance from the bearing hub to an outer edge of the rear wall.

According to another aspect, a plurality of blocking walls are positioned between respective pairs of outer diverging walls of a plurality of outer diverging walls.

According to yet another aspect, the respective T-shaped reinforcements and the plurality of blocking walls are positioned in an alternating configuration that extends concentrically about the bearing hub.

According to another aspect of the present disclosure, the respective T-shaped reinforcements and the blocking walls have a common wall thickness.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A tub for a laundry appliance, the tub comprising:

a rear wall having a bearing hub for receiving a drive shaft;

a plurality of inner radial walls that extend from the bearing hub to a corresponding convergence wall of a plurality of convergence walls;

a circumferential wall that extends concentrically about the bearing hub to engage one of the inner radial walls and the plurality of convergence walls; and a plurality of outer diverging walls that extends from the plurality of convergence walls to an outer edge of the rear wall.

2. The tub of claim 1, wherein the circumferential wall engages the plurality of convergence walls.

3. The tub of claim 1, wherein each convergence wall of the plurality of convergence walls is a cylindrical wall that extends concentrically about an imaginary reference point of each inner radial wall and at least two corresponding outer diverging walls of the plurality of outer diverging walls.

4. The tub of claim 1, wherein each of the inner radial walls and each of the outer diverging walls extends only a portion of a radial distance from the bearing hub to the outer edge of the rear wall.

5. The tub of claim 1, wherein each convergence wall of the plurality of convergence walls includes a cylindrical wall with an interior void.

6. The tub of claim 5, wherein the plurality of convergence walls interrupt the cylindrical wall to define the interior void.

7. The tub of claim 1, wherein the inner radial walls and the plurality of convergence walls have a common wall thickness.

8. The tub of claim 5, wherein each convergence wall of the plurality of convergence walls engages one inner radial wall and two outer diverging walls of the plurality of outer diverging walls.

9. A tub for a laundry appliance, the tub comprising:

a rear wall having a bearing hub for receiving a drive shaft;

a plurality of inner radial walls that extend between the bearing hub and a circumferential wall; and a plurality of outer diverging walls that extend between the circumferential wall and an outer edge of the rear wall, wherein each of the inner radial walls are positioned out of alignment with each of the outer diverging walls.

10. The tub of claim 9, wherein each of the inner radial walls and each of the outer diverging walls engages the circumferential wall at a unique location.

11. The tub of claim 9, wherein each of the inner radial walls and each of the outer diverging walls extends only a portion of a radial distance from the bearing hub to the outer edge of the rear wall.

12. The tub of claim 9, wherein the inner radial walls are aligned with a central rotational axis of the bearing hub, and wherein the outer diverging walls are aligned with a point along an imaginary concentric ring that is positioned between the bearing hub and the circumferential wall.

13. The tub of claim 9, wherein the circumferential wall is segmented into a plurality of concentrically extending walls that cooperate with the inner radial walls, respectively, to define a plurality of T-shaped reinforcements.

14. The tub of claim 13, wherein each of the T-shaped reinforcements includes a pair of opposing ends that are each attached to a corresponding outer diverging wall of the plurality of outer diverging walls.

15. The tub of claim 9, further comprising a plurality of blocking walls that are positioned between respective pairs of outer diverging walls of the plurality of outer diverging walls.

16. A tub for a laundry appliance, the tub comprising:

a rear wall having a bearing hub for receiving a drive shaft;

a plurality of inner radial walls that extend outward from the bearing hub to respective T-shaped reinforcements, each of the respective T-shaped reinforcements having a concentrically extending wall with opposing ends; and outer diverging walls that extend outward from each opposing end of each T-shaped reinforcement to an outer edge of the rear wall.

17. The tub of claim 16, wherein each of the inner radial walls and each of the outer diverging walls extends only a portion of a radial distance from the bearing hub to the outer edge of the rear wall.

18. The tub of claim 16, further comprising a plurality of blocking walls that are positioned between respective pairs of outer diverging walls of a plurality of outer diverging walls.

19. The tub of claim 18, wherein the respective T-shaped reinforcements and the plurality of blocking walls are positioned in an alternating configuration that extends concentrically about the bearing hub.

20. The tub of claim 18, wherein the respective T-shaped reinforcements and the blocking walls have a common wall thickness.

* * * * *